US007284617B2

(12) United States Patent
Pietras

(10) Patent No.: US 7,284,617 B2
(45) Date of Patent: Oct. 23, 2007

(54) CASING RUNNING HEAD

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 149 days.

(21) Appl. No.: 10/850,347

(22) Filed: May 20, 2004

(65) Prior Publication Data

US 2005/0257933 A1 Nov. 24, 2005

(51) Int. Cl.
*E21B 19/086* (2006.01)
*E21B 19/16* (2006.01)

(52) U.S. Cl. ..... 166/382; 166/77.4; 166/77.53; 166/85.1

(58) Field of Classification Search ..... None
See application file for complete search history.

(56) References Cited

U.S. PATENT DOCUMENTS

| | | | |
|---|---|---|---|
| 122,514 | A | 1/1872 | Bullock |
| 179,973 | A | 7/1876 | Thornton |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,128,430 | A | 9/1938 | Pryor |
| 2,167,338 | A | 7/1939 | Murcell |
| 2,184,681 | A | 12/1939 | Osmun et al. |

(Continued)

FOREIGN PATENT DOCUMENTS

| | | |
|---|---|---|
| CA | 2 496 102 | 4/2000 |

(Continued)

OTHER PUBLICATIONS

U.K. Search Report, Application No. GB0510259.5, dated Jul. 21, 2005.

(Continued)

*Primary Examiner*—Zakiya W. Bates
(74) *Attorney, Agent, or Firm*—Patterson & Sheridan, LLP

(57) ABSTRACT

Methods and apparatus for drilling with a top drive system. In one aspect, the apparatus provides a tubular gripping member for use with a top drive to handle a tubular comprising a housing operatively connected to the top drive and a plurality of gripping elements radially disposed in the housing for engaging the tubular, wherein moving the housing relative to the plurality of gripping elements causes the plurality of gripping elements to engage the tubular.

33 Claims, 9 Drawing Sheets

U.S. PATENT DOCUMENTS

| | | | |
|---|---|---|---|
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,570,080 | A | 10/1951 | Stone |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Bolling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,965,177 | A | 12/1960 | Bus, Sr., et al. |
| 2,978,047 | A | 4/1961 | DeVaan |
| 3,006,415 | A | 10/1961 | Burns et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,266,582 | A | 8/1966 | Homanick |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,638,989 | A | 2/1972 | Sandquist |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,706,347 | A | 12/1972 | Brown |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,766,991 | A | 10/1973 | Brown |
| 3,776,320 | A | 12/1973 | Brown |
| 3,780,883 | A | 12/1973 | Brown |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,870,114 | A | 3/1975 | Pulk |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,964,552 | A | 6/1976 | Slator |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |
| 4,194,383 | A | 3/1980 | Huzyak |
| 4,202,225 | A | 5/1980 | Sheldon et al. |
| 4,221,269 | A | 9/1980 | Hudson |
| 4,227,197 | A | 10/1980 | Nimmo et al. |
| 4,241,878 | A | 12/1980 | Underwood |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,277,197 | A | 7/1981 | Bingham |
| 4,280,380 | A | 7/1981 | Eshghy |
| 4,281,722 | A | 8/1981 | Tucker et al. |
| 4,287,949 | A | 9/1981 | Lindsey, Jr. |

4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
6,374,506 B1 4/1993 Clay
5,224,540 A 7/1993 Streich et al.

5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle
5,546,317 A 8/1996 Andrieu
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.

6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 * 11/2001 Scott et al. ..... 175/162
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,924 B1 4/2002 Hanton et al.
6,378,627 B1 4/2002 Tubel et al.
6,378,630 B1 4/2002 Ritorto et al.
6,378,633 B1 4/2002 Moore et al.
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny et al.
6,655,460 B2 12/2003 Bailey et al.
6,666,274 B2 12/2003 Hughes
6,668,684 B2 * 12/2003 Allen et al. ..... 81/57.15
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Metcalfe et al.
6,745,834 B2 6/2004 Davis et al.
6,752,211 B2 6/2004 Dewey et al.
6,776,233 B2 8/2004 Meehan
6,832,656 B2 12/2004 Cameron
6,832,658 B2 12/2004 Keast
6,837,313 B2 1/2005 Hosie et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway
6,868,906 B1 3/2005 Vail, III et al.
6,877,553 B2 4/2005 Cameron
6,892,835 B2 5/2005 Shahin et al.
6,896,075 B2 5/2005 Haugen et al.
6,899,186 B2 5/2005 Galloway et al.
6,899,772 B1 5/2005 Buytaert et al.
6,907,934 B2 6/2005 Kauffman et al.
7,096,977 B2 8/2006 Juhasz et al.
7,100,698 B2 9/2006 Kracik et al.

| | | | |
|---|---|---|---|
| 2001/0042625 | A1 | 11/2001 | Appleton |
| 2002/0029878 | A1 | 3/2002 | Victor |
| 2002/0040787 | A1 | 4/2002 | Cook et al. |
| 2002/0066556 | A1 | 6/2002 | Goode et al. |
| 2002/0108748 | A1 | 8/2002 | Keyes |
| 2002/0170720 | A1 | 11/2002 | Haugen |
| 2002/0189863 | A1 | 12/2002 | Wardley |
| 2003/0029641 | A1 | 2/2003 | Meehan |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0155159 | A1 | 8/2003 | Slack et al. |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0217865 | A1 | 11/2003 | Simpson et al. |
| 2003/0221519 | A1 | 12/2003 | Haugen et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0060697 | A1 | 4/2004 | Tilton et al. |
| 2004/0069500 | A1 | 4/2004 | Haugen |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | |
|---|---|---|
| CA | 2 307 386 | 11/2000 |
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 347 445 | 9/2000 |
| GB | 2 348 223 | 9/2000 |
| GB | 2 349 401 | 9/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2 389 130 | 12/2003 |
| JP | 2001-1733349 | 6/2001 |
| WO | WO90-06418 | 6/1990 |
| WO | WO91-16520 | 10/1991 |
| WO | WO92-01139 | 1/1992 |
| WO | WO92-18743 | 10/1992 |
| WO | WO92-20899 | 11/1992 |
| WO | WO93-07358 | 4/1993 |
| WO | WO93-24728 | 12/1993 |
| WO | WO95-10686 | 4/1995 |
| WO | WO96-18799 | 6/1996 |
| WO | WO96-28635 | 9/1996 |
| WO | WO97-05360 | 2/1997 |
| WO | WO97-08418 | 3/1997 |
| WO | WO98/01651 | 1/1998 |
| WO | WO98-05844 | 2/1998 |
| WO | WO98-09053 | 3/1998 |

| | | |
|---|---|---|
| WO | WO98-11322 | 3/1998 |
| WO | WO98-32948 | 7/1998 |
| WO | WO98-55730 | 12/1998 |
| WO | WO99-04135 | 1/1999 |
| WO | WO99-11902 | 3/1999 |
| WO | WO99-23354 | 5/1999 |
| WO | WO99-24689 | 5/1999 |
| WO | WO99-35368 | 7/1999 |
| WO | WO99-37881 | 7/1999 |
| WO | WO99-41485 | 8/1999 |
| WO | WO99-50528 | 10/1999 |
| WO | WO99-58810 | 11/1999 |
| WO | WO99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00/41467 | 7/2000 |
| WO | WO 00-46484 | 8/2000 |
| WO | WO 00-50730 | 8/2000 |
| WO | WO 00/52297 | 9/2000 |
| WO | WO 00-66879 | 11/2000 |
| WO | WO 01-12946 | 2/2001 |
| WO | WO 01/33033 | 5/2001 |
| WO | WO 01-46550 | 6/2001 |
| WO | WO 01/59253 | 8/2001 |
| WO | WO 01-79650 | 10/2001 |
| WO | WO 01/79652 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |
| WO | WO 2004/079155 | 9/2004 |

OTHER PUBLICATIONS

Alexander Sas-Jaworsky and J. G. Williams, Development of Composite Coiled Tubing For Oilfeild Services, SPE 26536, Society of Petroleum Engineers, Inc., 1993.

A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.

G. F. Boykin, The Role of A Worldwide Drilling Organization and the Road to the Future, SPE/IADC 37630, 1997.

M. S. Fuller, M. Littler, and I. Pollock, Innovative Way To Cement a Liner Utilizing a New Inner String Liner Cementing Process, 1998.

Helio Santos, Consequences and Relevance of Drillstring Vibration on Wellbore Stability, SPE/IADC 52820, 1999.

Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.

C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.

Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.

Mike Bullock, Tom Grant, Rick Sizemore, Chan Daigle, and Pat York, Using Expandable Solid Tubulars To Solve Well Construction Challenges In Deep Waters And Maturing Properties, IBP 27500, Brazilian Petroleum Institute—IBP, 2000.

Coiled Tubing Handbook, World Oil, Gulf Publishing Company, 1993.

Hahn, et al., "Simultaneous Drill and Case Technology—Case Histories, Status and Options for Further Development, " Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Costs By 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPE/IADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling," World Oil, Sep. 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part 1—Casing Drilling With Directional Steering In The U.S. Gulf Of Mexico," Offshore, Jan. 2001, pp. 50-52.
Warren, et al., "Drilling Technology: Part II—Casing Drilling With Directional Steering in The Gulf Of Mexico," Offshore, Feb. 2001, pp. 40-42.
Shepard, et al., "Casing Drilling: An Emerging Technology, " IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE-IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono-Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Linear And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retreactable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Dennis L. Bickford and Mark J. Mabile, Casing Drilling Rig Selection For Stratton Field, World Oil, Vol. 226 No., Mar. 2005.
G H. Kamphorst, G. L. Van Wechem, W. Boom, D. Bottger, And K. Koch, Casing Running Tool, SPE/IADC 52770, Mar. 1999.

* cited by examiner

CASING RUNNING HEAD

BACKGROUND OF THE INVENTION

1. Field of the Invention

The present invention relates to methods and apparatus for drilling with top drive systems. Particularly, the invention relates to methods and apparatus for adapting a top drive for use with running casing. More particularly still, the invention relates to a torque head for engaging with a tubular and rotating the same.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, one conventional method to complete a well includes drilling to a first designated depth with a drill bit on a drill string. Then, the drill string is removed and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to set the casing into the wellbore. In this manner, wells are typically formed with two or more strings of casing of an ever-decreasing diameter.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Another method of performing well completion operations involves drilling with casing, as opposed to the first method of drilling and then setting the casing. In this method, the casing string is run into the wellbore along with a drill bit for drilling the subsequent, smaller diameter hole located in the interior of the existing casing string. The drill bit is operated by rotation of the drill string from the surface of the wellbore. Once the borehole is formed, the attached casing string may be cemented in the borehole. The drill bit is either removed or destroyed by the drilling of a subsequent borehole. The subsequent borehole may be drilled by a second working string comprising a second drill bit disposed at the end of a second casing that is of sufficient size to line the wall of the borehole formed. The second drill bit should be smaller than the first drill bit so that it fits within the existing casing string. In this respect, this method requires at least one run-in into the wellbore per casing string that is set into the wellbore.

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

In order to drill with casing, most existing top drives require a threaded crossover adapter to connect to the casing. This is because the quill of the top drives is not sized to connect with the threads of the casing. The crossover adapter is design to alleviate this problem. Typically, one end of the crossover adapter is designed to connect with the quill, while the other end is designed to connect with the casing.

However, the process of connecting and disconnecting a casing is time consuming. For example, each time a new casing is added, the casing string must be disconnected from the crossover adapter. Thereafter, the crossover must be threaded into the new casing before the casing string may be run. Furthermore, this process also increases the likelihood of damage to the threads, thereby increasing the potential for downtime.

There is a need, therefore, for methods and apparatus for coupling a casing to the top drive for drilling with casing operations. There is a further need for methods and apparatus for running casing with a top drive in an efficient manner. There is also a need for methods and apparatus for running casing with reduced damage to the casings.

SUMMARY OF THE INVENTION

The present invention generally relates to a method and apparatus for drilling with a top drive system. Particularly, the present invention relates to methods and apparatus for handling tubulars using a top drive system.

In one aspect, the present invention provides a tubular gripping member for use with a top drive to handle a tubular comprising a housing operatively connected to the top drive and a plurality of gripping elements radially disposed in the housing for engaging the tubular, wherein moving the housing relative the plurality of gripping elements causes the plurality of gripping elements to engage the tubular.

In another aspect, the present invention provides a method of handling a tubular comprising providing a top drive operatively connected to a gripping head. The gripping head has a housing, a plurality of gripping elements radially disposed in the housing for engaging the tubular, and a plurality of engagement members movably disposed on each of the plurality of gripping elements. The method further includes disposing the tubular within the plurality of gripping elements, moving the housing relative to the plurality of gripping elements, engaging the tubular, and pivoting the plurality of engagement members.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Aspects of the present invention provide a top drive adapter for gripping a casing for drilling with casing. The top drive adapter includes rotating unit for connection with the top drive to transfer torque. The top drive adapter also has a plurality of gripping elements disposed in a housing. Moving the housing axially relative to the plurality of gripping elements causes the gripping elements to apply an initial gripping pressure on the casing. The gripping elements have engagement members for contacting or gripping the casing. An axial load acting on the engagement members causes the engagement members to pivot axially and support the axial load.

Figure 1:
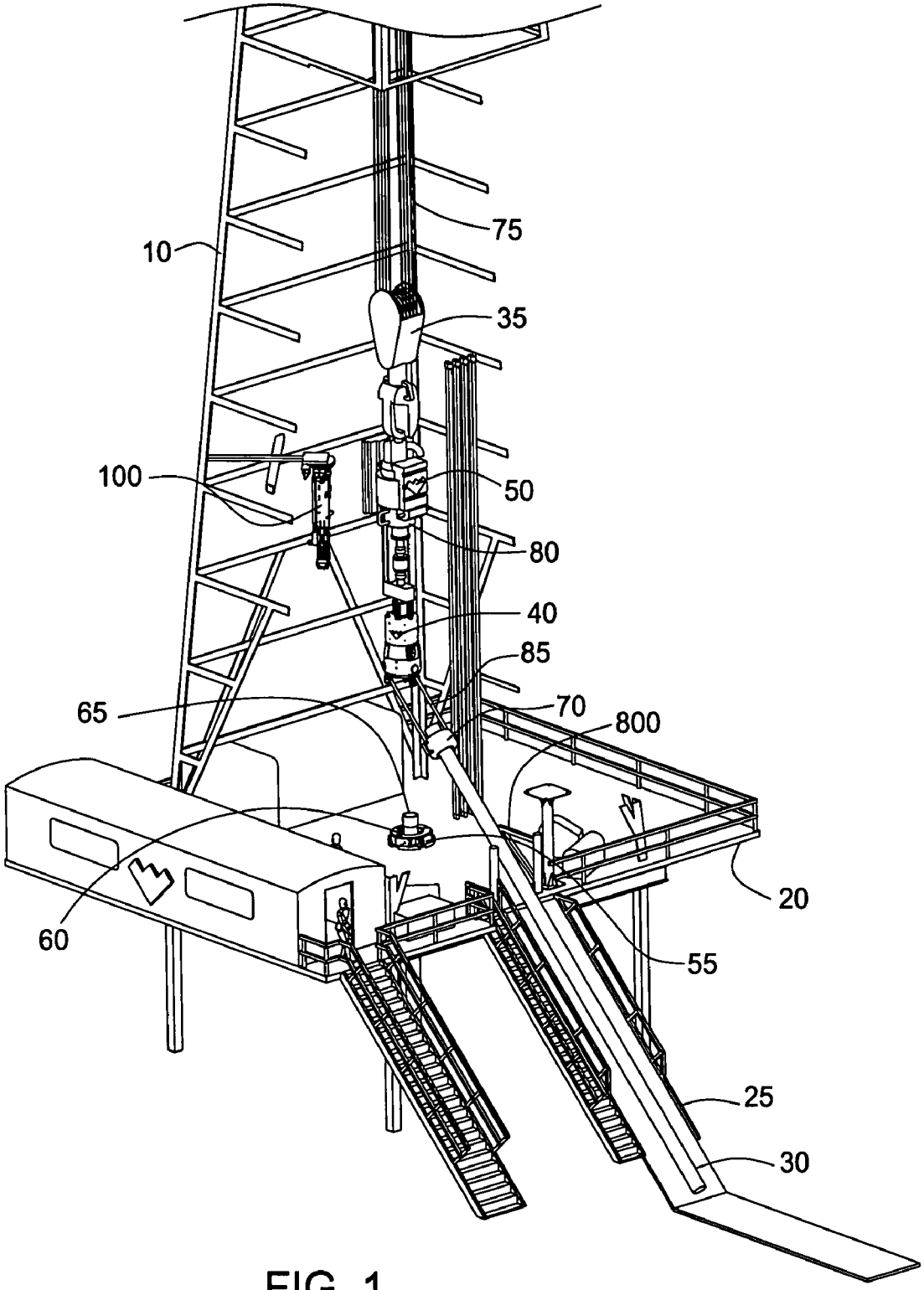
FIG. 1 is a partial view of a rig having a top drive system according to aspects of the present invention.

FIG. 1 shows a drilling rig 10 applicable to drilling with casing operations or a wellbore operation that involves picking up/laying down tubulars. The drilling rig 10 is located above a formation at a surface of a well. The drilling rig 10 includes a rig floor 20 and a v-door 800. The rig floor 20 has a hole 55 therethrough, the center of which is termed the well center. A spider 60 is disposed around or within the hole 55 to grippingly engage the casings 30, 65 at various stages of the drilling operation. As used herein, each casing 30, 65 may include a single casing or a casing string having more than one casing. Furthermore, aspects of the present invention are equally applicable to other types of wellbore tubulars, such as drill pipe.

The drilling rig 10 includes a traveling block 35 suspended by cables 75 above the rig floor 20. The traveling block 35 holds the top drive 50 above the rig floor 20 and may be caused to move the top drive 50 axially. The top drive 50 includes a motor 80 which is used to rotate the casing 30, 65 at various stages of the operation, such as during drilling with casing or while making up or breaking out a connection between the casings 30, 65. A railing system (not shown) is coupled to the top drive 50 to guide the axial movement of the top drive 50 and to prevent the top drive 50 from rotational movement during rotation of the casings 30, 65.

Disposed below the top drive 50 is a tubular gripping member such as a torque head 40. The torque head 40 may be utilized to grip an upper portion of the casing 30 and impart torque from the top drive to the casing 30. The torque head 40 may be coupled to an elevator 70 using one or more bails 85 to facilitate the movement of the casing 30 above the rig floor 20. Additionally, the rig 10 may include a pipe handling arm 100 to assist in aligning the tubulars 30, 65 for connection.

Figure 2:
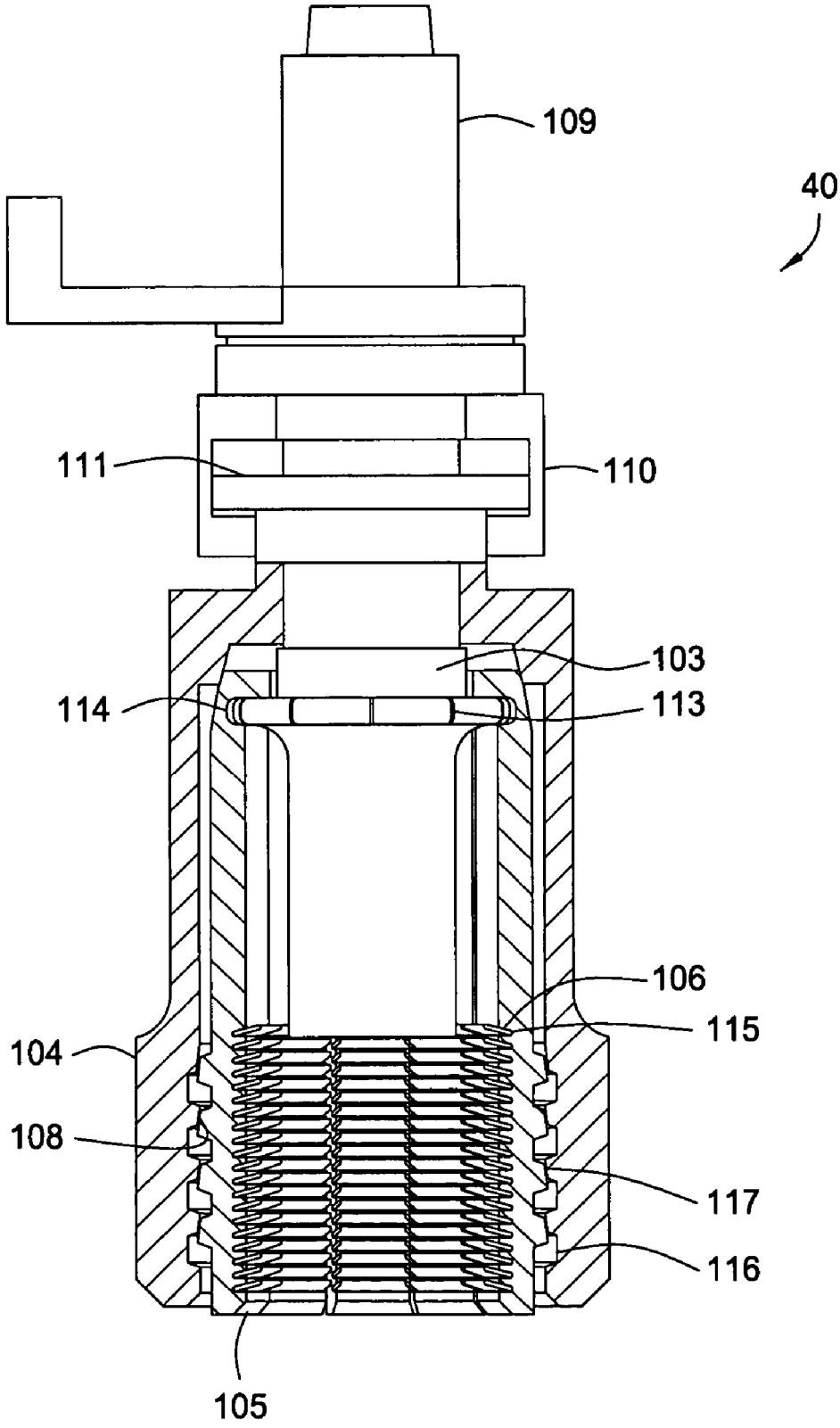
FIG. 2 shows an exemplary torque head according to aspects of the present invention. As shown, the torque head is in a partially actuated position.

FIG. 2 illustrates a cross-sectional view of an exemplary torque head 40 according to aspects of the present invention. Because the torque head 40 is adapted to couple the top drive 50 to the casing 30 the torque head 40 includes a mandrel 103 coupled to a rotary unit 109 for connection to the top drive 50. In this respect, the top drive 50 may rotate, raise, or lower the torque head 40 for drilling with casing. The mandrel 103 includes a load collar 113 for coupling one or more gripping elements 105 to the mandrel 103. As shown in FIG. 2, an upper portion of the gripping element 105 includes a recess 114 for engagement with the load collar 113 of the mandrel 103. The gripping elements 105 are circumferentially disposed around the mandrel 103.

A housing 104 surrounds the gripping elements 105 and ensures the gripping elements 105 remain coupled to the mandrel 103. The housing 104 is actuatable by a hydraulic cylinder 110 disposed on the mandrel 103. Particularly, an upper portion of the housing 104 is coupled to the piston 111 of the hydraulic cylinder 110. Actuation of the piston 111 causes the housing 104 to move axially relative to the mandrel 103.

Figure 3:
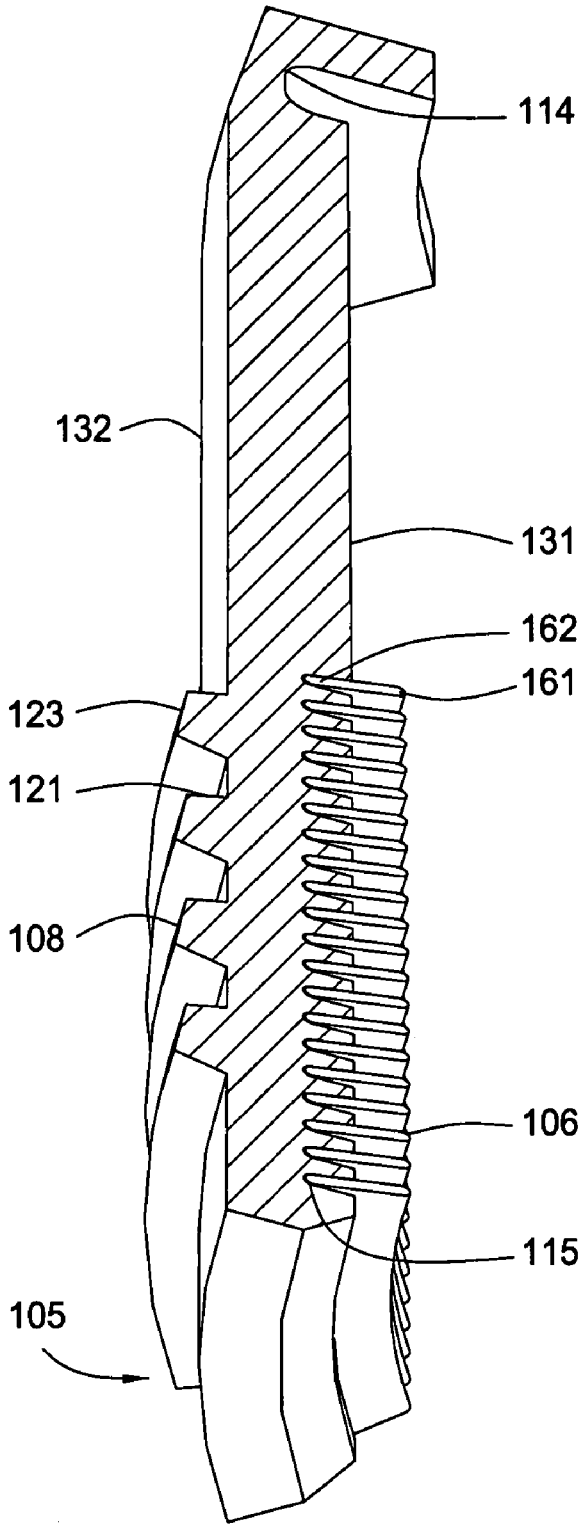
FIG. 3 is a perspective view of the gripping element of the torque head of FIG. 2.
Figure 4:
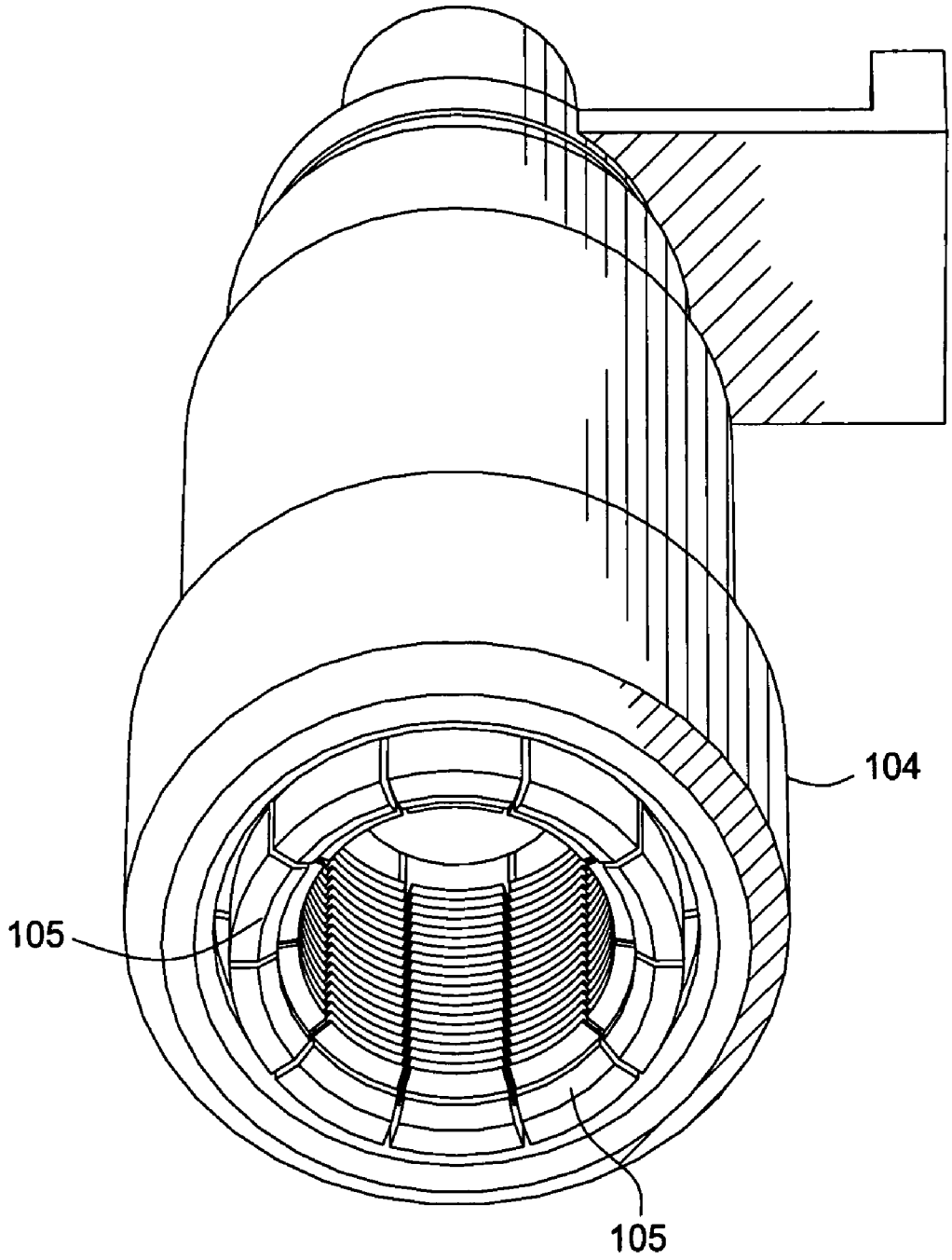
FIG. 4 is a perspective view of the torque head of FIG. 2.

The gripping elements 105 are adapted to engage and retain the casing 30 once the casing 30 is inserted into the housing 104. As shown in FIG. 3, the gripping elements 105 include an upper end having a recess 114 for coupling to the mandrel 103 and a lower end having one or more engagement members 106. A width of the gripping elements 105 may be arcuate in shape such that the gripping elements 105 may be circumferentially disposed to form a substantially tubular structure to engage a tubular such as a casing or a pipe. FIG. 4 is a perspective view of the torque head 40 showing the gripping elements 105 circumferentially disposed inside the housing 104.

Referring again to FIG. 3, the gripping elements 105 include an arcuate interior surface 131 for engaging the tubular and an arcuate exterior surface 132 for engaging the housing 104. In one embodiment, the interior surface 131 includes one or more slots 115 for receiving one or more engagement members 106. Preferably, the engagement members 106 are pivotable within the slots 115. Initially, the engagement members 106 are disposed at an upward angle in a direction towards the upper portion of the mandrel 103. In other words, the distal end 161 of the engagement members 106 is higher than the proximal end 162. More preferably, each engagement member 106 is set at the same angle. When the engagement members engage the casing string, the load of the casing string will cause the engagement members 106 to pivot in the slots 115 thereby carrying the casing string load. It is believed that this arrangement allows the engagement members 106 to carry an equal, partial load of the casing 30. The engagement members 106 may be designed with any suitable contact surface as is known to a person of ordinary skill in the art. For example, the contact surface may be a smooth surface or a tooth structure to increase the load carrying capacity.

Figure 5:
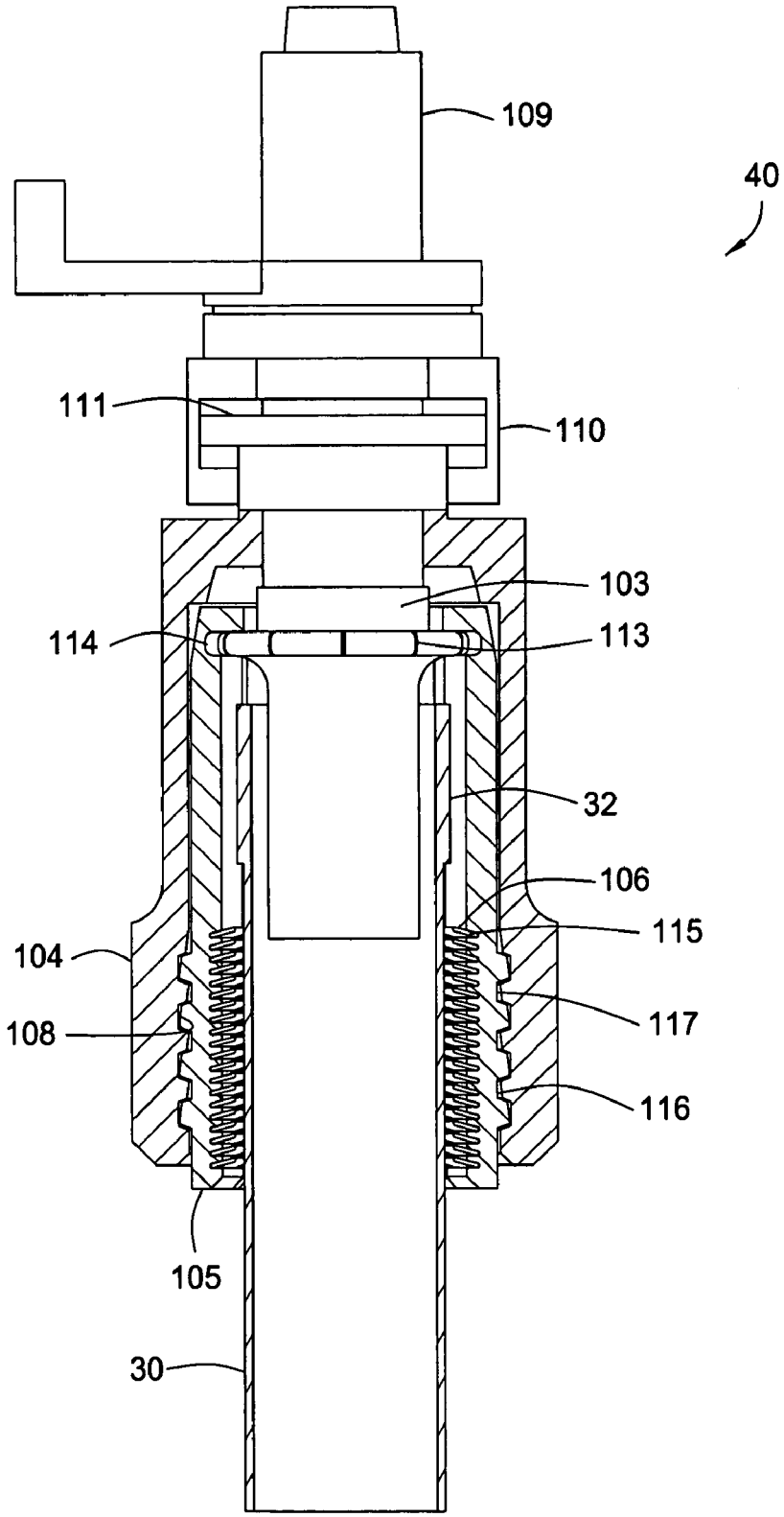
FIG. 5 shows the torque head of FIG. 2 in an unactuated position.

The exterior surface 132 of the gripping elements 105 is adapted to interface with the interior surface of the housing 104 to move the gripping elements 105 radially relative to the housing 104. In one embodiment, the gripping elements 105 may interface with the housing 104 using a complementary key and groove system. As shown in FIGS. 3 and 4, the lower, exterior portion of the gripping elements 105 includes one or more keys 108 formed thereon. The keys 108 are adapted to fit in a complementary groove 116 formed on the inner surface of the housing 104 when the torque head 40 is in the unactuated or "unlocked" position, as illustrated in FIG. 5. Referring to FIG. 2, the housing 104 includes one or more keys 117 formed between the grooves 116. The keys 117 of the housing 104 reside between the keys 108 of the gripping elements 105 when the torque head 40 is in the unlocked position.

In one aspect, the housing 104 may be actuated to move the keys 108 of the housing 104 and the keys 117 of the gripping element 105 into an actuated or locking position. FIG. 2 shows the keys 108, 117 in a partially locked position. To this end, the keys 108 of the gripping elements 105 include an upper surface 121 and an abutment surface 123. The upper surface 121 of the keys 108 may be inclined downward to facilitate the movement of the keys 108 of the gripping elements 105 out of the grooves 116 of the housing 104. Similarly, the keys 117 of the housing 104 include a lower surface 122 and an abutment surface 124. The lower surface 122 is adapted to engage the upper surface of the key 108 of the gripping element 105 as the housing 104 is lowered. Due to the incline of the upper surface 121, the gripping elements 105 move radially inward to engage the casing 30 while the housing 104 is lowered.

The abutment surfaces 123, 124 are adapted to provide a self locking function. In one embodiment, the abutment surface 123 of the gripping elements 105 is inclined slightly downward, and the abutment surface 124 of the housing 104 has a complementary incline. When the two abutment surfaces 123, 124 engage, the incline causes the gripping elements 105 to move radially toward the axial center to establish its grip on the casing 30. Preferably, the abutment surface 122 of the gripping elements 105 is angled at about ten degrees or less relative to a vertical axis. More preferably, the abutment surface 122 of the gripping elements 105 is inclined at about seven degrees or less relative to a vertical axis.

Referring to FIG. 1, a casing 30 is shown as it is being brought up to the rig 10 for connection with a casing string 65. The casing string 65, which was previously drilled into the formation (not shown) to form the wellbore (not shown), is shown disposed within the hole 55 in the rig floor 20. The casing string 65 may include one or more joints or sections of casing threadedly connected to one another. The casing string 65 is shown engaged by the spider 60. The spider 60 supports the casing string 65 in the wellbore and prevents the axial and rotational movement of the casing string 65 relative to the rig floor 20. As shown, a threaded connection of the casing string 65, or the box, is accessible from the rig floor 20.

In FIG. 1, the top drive 50, the torque head 40, and the elevator 70 are shown positioned proximate the rig floor 20. The casing 30 may initially be disposed on the rack 25, which may include a pick up/lay down machine. The lower portion of the casing 30 includes a threaded connection, or the pin, which may mate with the box of the casing string 65. The elevator 70 is shown engaging an upper portion of the casing 30 and ready to be hoisted by the cables 75 suspending the traveling block 35. The elevator 70 may be used to transport the casing 30 from a rack 25 or a pickup/lay down machine to the well center. The elevator 70 may include any suitable elevator known to a person of ordinary skill in the art. The elevator defines a central opening to accommodate the casing 30. The bails 85 interconnect the elevator 70 to the torque head 40 and are pivotable relative to the torque head 40.

While the casing is moved towards the well center, the pipe handling arm 100 is actuated to guide and align the casing 30 with the casing string 65 for connection therewith. A suitable pipe handling arm is disclosed in U.S. Pat. No. 6,591,471 issued to Hollingsworth on Jul. 15, 2003, assigned to the assignee of the present invention and incorporated by reference herein in its entirety. Another suitable pipe handling arm is disclosed in U.S. patent application Ser. No. 10/382,353, filed on Mar. 5, 2003, entitled "Positioning and Spinning Device," which application is assigned to the same assignee of the present invention and incorporated by reference herein in its entirety. An exemplary pipe handling arm 100 includes a gripping member for engaging the casing 30 during operation. The pipe handling arm 100 is adapted and designed to move in a plane substantially parallel to the rig floor 20 to guide the casing 30 into alignment with the casing 65 in the spider 60.

After the casing is guided into alignment by the pipe handling arm 100, the torque head 40 is lowered relative to the casing 30 and positioned around the upper portion of the casing 30. As the casing 30 is inserted into the torque head 40, the coupling 32 of the casing 30 forces the gripping elements 105 to expand radially. In this respect, the keys 108 of the gripping elements 105 move into the grooves 116 of the housing 104. FIG. 5 shows the casing 30 inserted into the torque head 40. It can be seen that coupling 32 is located above the gripping elements 105.

Figure 6:
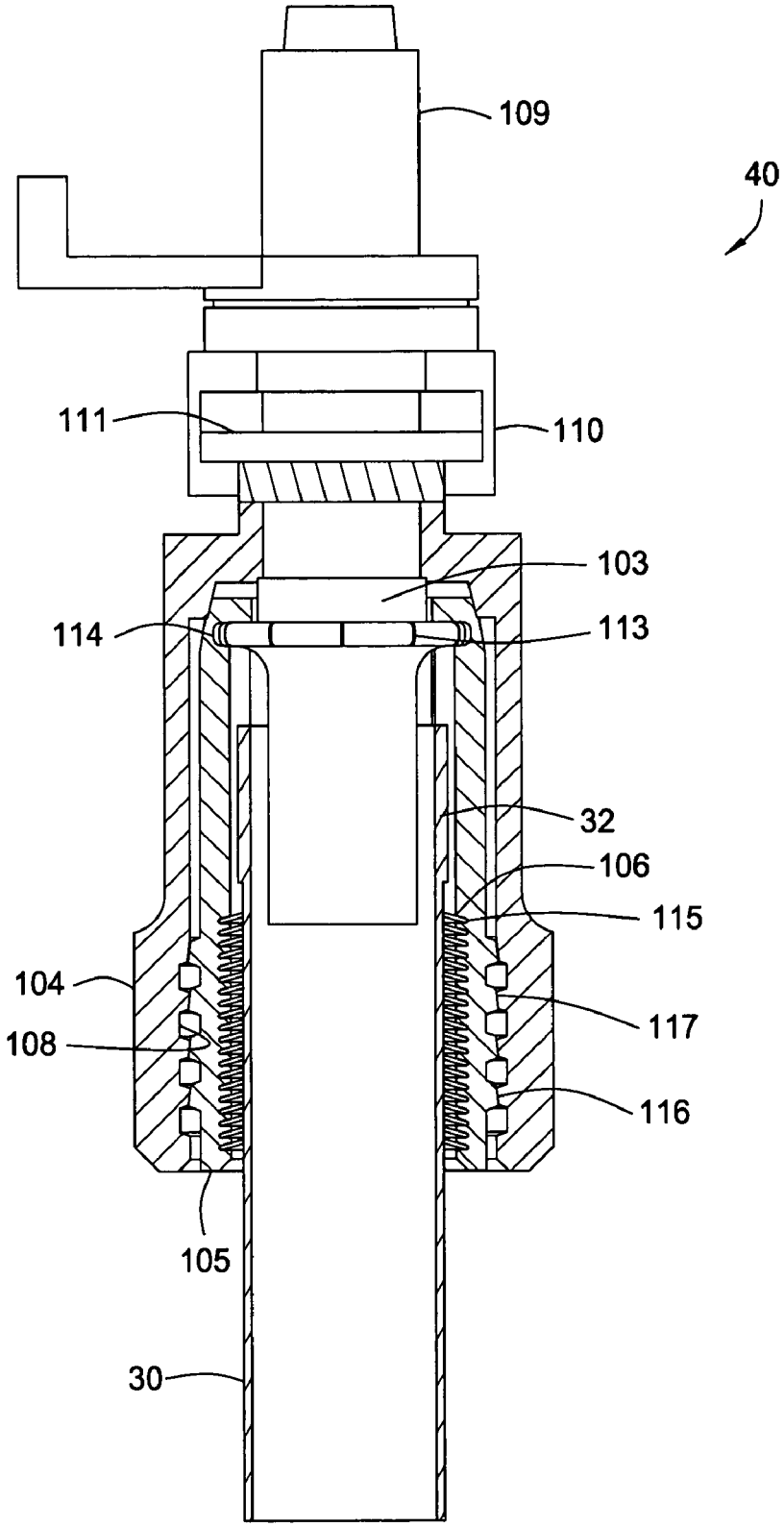
FIG. 6 shows the torque head of FIG. 2 in an actuated position.

To grip the casing 30, the hydraulic cylinder 110 is actuated to move the piston 111 downward. In turn, the housing 104 is lowered relative to the gripping elements 105. Initially, the lower surface 122 of the housing 104 encounters the upper surface 121 of the gripping elements 105. The incline of the upper and lower surfaces 121, 122 facilitate the movement of the gripping elements 105 out of the groove 116 and the lowering of the housing 104. Additionally, the incline also causes the gripping elements 105 to move radially to apply a gripping force on the casing 30. As shown in FIG. 2, the housing 104 has been lowered relative to the gripping elements 105. Additionally, the keys 108 of the gripping elements 105 have moved out of the groove 116. The housing 104 is lowered until the abutment surfaces 123, 124 of the keys 108, 117 substantially engage each other, as shown in FIG. 6. It can be seen in FIG. 6 that the piston 111 is fully actuated.

During drilling operation, the casing string load will pull the casing 30 down. Due to this movement, the engagement members 106 will pivot in the slot 115 of the gripping elements 105 to clamp the casing 30. In this respect, the engagement members 106 will work as an axial free running drive. Moreover, because the engagement members 106 are all set at the same angle, each of the engagement members 106 carries an equal amount of the casing string weight. Additionally, the radial clamping force will be balanced by the housing 104. In one embodiment, when the key angle between the key 117 of the housing 104 and the key 108 of the gripping element 105 is less than seven degrees, the radial force will be distributed across the housing 104.

When the casing string load is removed, such as actuating the spider 60 to retain the casing string, the engagement members 106 will immediately release the radial force exerted on the casing 30. Thereafter, the piston is deactuated to raise the housing 104 relative to the gripping elements 105. The casing 30 may be removed when the keys 108 of the gripping elements 105 return to their respective grooves 116.

In another aspect, the torque head 40 may be used to transfer torque. In this respect, an appropriate hydraulic cylinder may be selected to apply a sufficient force to clamp the casing 30.

Figure 7:
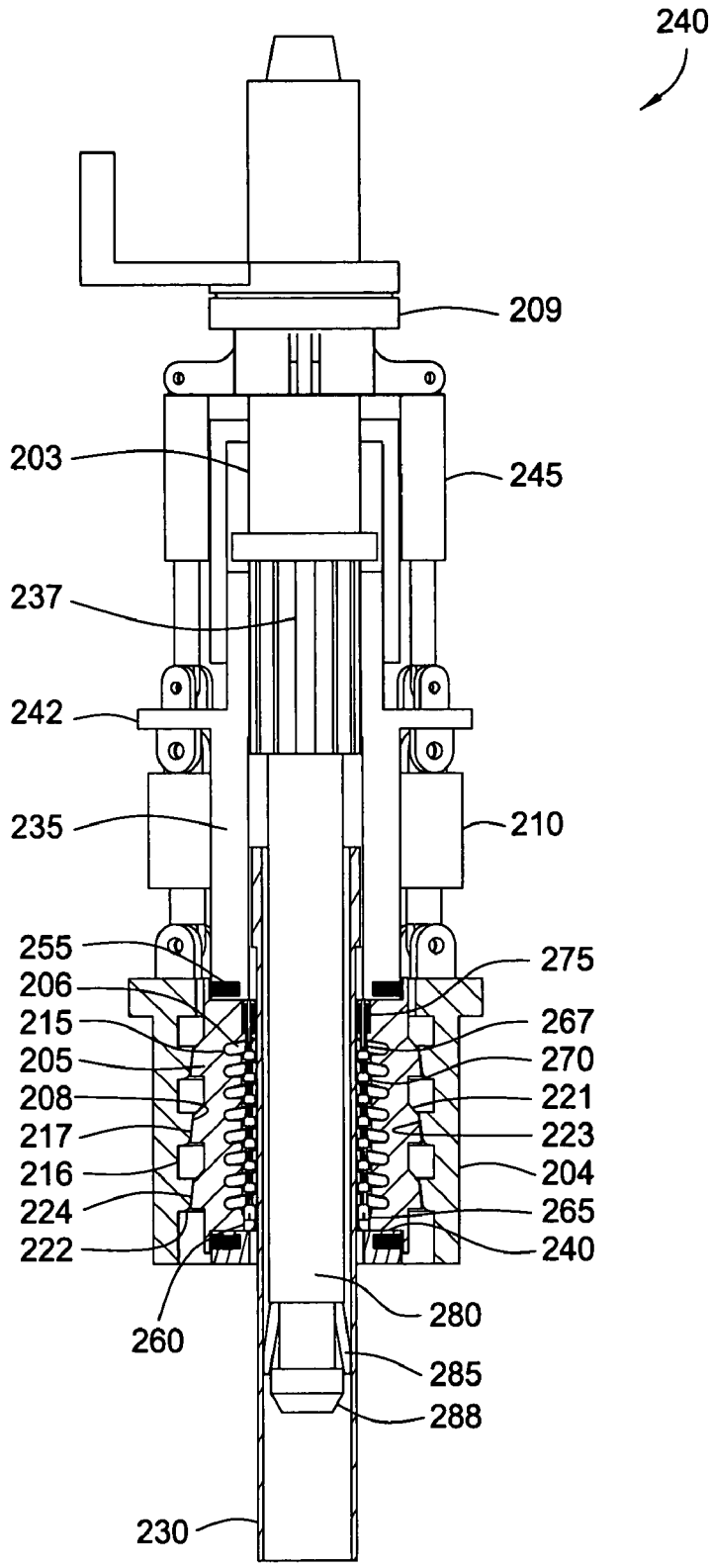
FIG. 7 shows another embodiment of a torque head according to aspects of the present invention.

FIG. 7 presents another embodiment of a torque head 240 according to aspects of the present invention. The torque head 240 includes a rotary unit 209 for connection with the top drive 50 and transmitting torque. A mandrel 203 extends below the rotary unit 209 and is coupled to an upper end of a tubular body 235 using a spline and groove connection 237. The spline and groove connection 237 allows the body 235 to move axially relative to the mandrel 203 while still allowing torque to be transmitted to rotate the body 235. The lower portion of the body 235 includes one or more windows 240 formed through a wall of the body 235. The windows 240 are adapted to contain a gripping element 205. Preferably, eight windows 240 are formed to contain eight gripping elements 205.

The outer surface of the body 235 includes a flange 242. One or more compensating cylinders 245 connect the flange 242 to the rotary unit. In this respect, the compensating cylinders 245 control the axial movement of the body 235. The compensating cylinder 245 is particularly useful during makeup or breakout of tubulars. For example, the compensating cylinder 245 may allow the body 235 to move axially to accommodate the change in axial distance between the tubulars as the threads are made. An exemplary compensating cylinder is a piston and cylinder assembly. The piston and cylinder assembly may be actuated hydraulically, pneumatically, or by any other manner known to a person of ordinary skill in the art. A suitable alternate compensating cylinder is disclosed in U.S. Pat. No. 6,056,060, which patent is herein incorporated by reference in its entirety and is assigned to the same assignee of the present invention.

A housing 204 is disposed around the windows 240 of the body 235. The housing 204 is coupled to the flange 242 using a one or more actuating cylinders 210. In this respect, the housing 204 may be raised or lowered relative to the body 235. The interior of the housing 204 includes a key and groove configuration for interfacing with the gripping element 205. In one embodiment, the key 217 includes an inclined abutment surface 224 and an inclined lower surface 222. Preferably, the transition between the lower surface 222 and the abutment surface 224 is curved to facilitate lowering of the housing 204 relative to the body 235.

A gripping element 205 is disposed in each of the windows 240 in the body 235. In one embodiment, the gripping element 205 has an exterior surface adapted to interface with the key and groove configuration of the housing 204, as shown in FIGS. 7 and 8. Particularly, keys 208 are formed on the exterior surface and between the keys 208 are grooves that may accommodate the key 217 of the housing 204. The keys 208 of the gripping element 205 include an upper surface 221 and an abutment surface 223. The upper surface 221 is inclined downward to facilitate movement of the keys 217 of the housing 204. The abutment surface 223 has an incline complementary to the abutment surface 224 of the housing 204. A collar 250 extends from the upper and lower ends of the exterior surface of the gripping elements 205. The collars 250 engage the outer surface of the body 235 to limit the inward radial movement of the gripping elements 205. Preferably, a biasing member 255 is disposed between the collar and the body 235 to bias the gripping element 205 away from the body 235. In one embodiment, the biasing member 255 may be a spring.

The interior surface of the gripping element 205 includes one or more engagement members 206. In one embodiment, each engagement member 206 is disposed in a slot 215 formed in the interior surface of the gripping element 205. Preferably, the engagement members 206 are pivotable in the slot 215. The portion of the engagement member 206 disposed in the interior of the slot 215 may be arcuate in shape to facilitate the pivoting motion. The tubular contact surface of the engagement members 257 may be smooth or rough, or have teeth formed thereon.

In another aspect, the gripping element 205 may include a retracting mechanism to control movement of the engagement members 206. In one embodiment, an axial bore 260 is formed adjacent the interior surface of the gripping element 205. An actuating rod 265 is disposed in the bore 260 and through a recess 267 of the engagement members 206. The actuating rod 265 includes one or more supports 270 having an outer diameter larger than the recess 267 of the engagement members 206. A support 270 is positioned on the actuating rod 265 at a level below each engagement member 206 such that the engagement members 206 rest on their respective support 270.

Figure 8A:
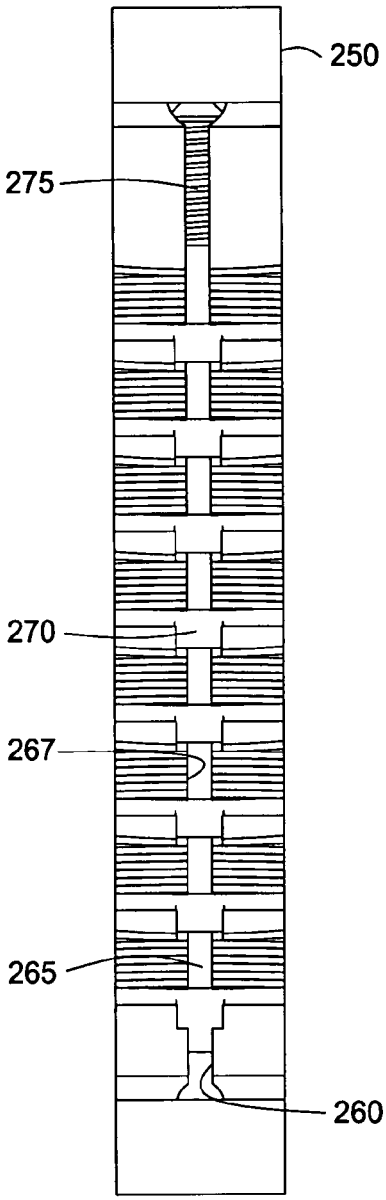
FIGS. 8A-B are two different views of an exemplary gripping element for use with the torque head of FIG. 7.
Figure 8B:
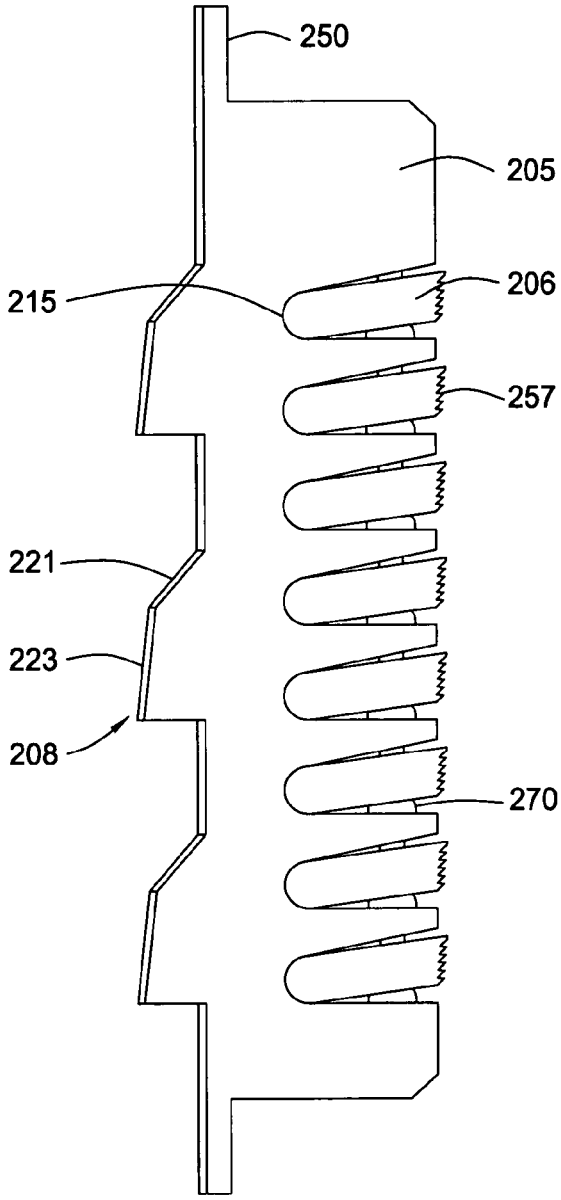

A biasing member 275 coupled to the actuating rod 265 is disposed at an upper end of the bore 260. In the relaxed position, the biasing member 275 biases the actuating rod 265 in the upward position. In this respect, the actuating rod 265 places the engagement members 206 in the retracted position, or pivoted upward position, as shown in FIGS. 8A-B. When the biasing member 275 is compressed, the actuating rod 265 is placed in the downward position. In this respect, the engagement members 206 are in the engaged position, or pivoted downward such that it is relatively closer to a horizontal axis than the retracted position.

In operation, the casing 230 is inserted into the body 235 of the torque head 240. At this point, the keys 208 of the gripping element 205 are disposed in their respective groove 216 in the housing 204. Additionally, the actuating rod 265 is in the upward position, thereby placing the engagement members 206 in the retracted position. As the casing 230 is inserted into the torque head 240, the coupling moves across the gripping elements 205 and forces the gripping elements 205 to move radially outward. After the coupling moves past the gripping elements 205, the biasing members 255 bias the gripping elements 205 to maintain engagement with the casing 30.

Once the casing 230 is received in the torque head 240, the actuating cylinder 210 is activated to lower the housing 204 relative to the body 235. Initially, the lower surface 222 of the housing 204 encounters the upper surface 221 of the gripping elements 205. The incline of the upper and lower surfaces 221, 222 facilitate the movement of the gripping elements 205 out of the groove 216 and the lowering of the housing 204. Additionally, the incline also causes the gripping elements 205 to move radially to apply a gripping force on the casing 30. Preferably, the gripping elements 205 move radially in a direction substantially perpendicular to the vertical axis of the casing 30. The housing 204 continues to be lowered until the abutment surfaces 223, 224 of the keys 208, 217 substantially engage each other, as shown in FIG. 7. During the movement of the housing 204, the biasing members 255 between the collars 250 and the body 235 are compressed. Additionally, the weight of the casing 30 may force the engagement members 205 to pivot slightly downward, which, in turn, causes the actuating rod 265 to compress the biasing member 275. In this respect, a radial clamping force is applied to support the axial load of the casing 30.

To makeup the casing 230 to the casing string 65, the top drive 50 may be operated to provide torque to rotate the casing 230 relative to the casing string 65. During makeup, the compensating cylinder 245 is activated to compensate for the change in axial distance as a result of the threaded engagement. In this respect, the body 235 is allowed to move axially relative to the mandrel 203 using the spline and groove connection 237.

During drilling operation, the entire casing string load is supported by the torque head 240. Particularly, the heavier casing string load further pivots the engagement members 206 in the slot 215 of the gripping elements 205. In this respect, the casing string load is distributed among the engagement members 206, thereby allowing the torque head 240 to work as an axial free running drive. Moreover, because the engagement members 206 are all set the same angle, each of the engagement members 206 carries an equal amount of the casing string weight. Additionally, the radial clamping force will be balanced by the housing 204. In one embodiment, when the angle between the key 217 of the housing 204 and the key 208 of the gripping element 205 is less than seven degrees, the radial force will be distributed across the housing 204. In this manner, the torque head according to aspects of the present invention may be used to connect tubulars and generally used to perform tubular handling operations.

Figure 9:
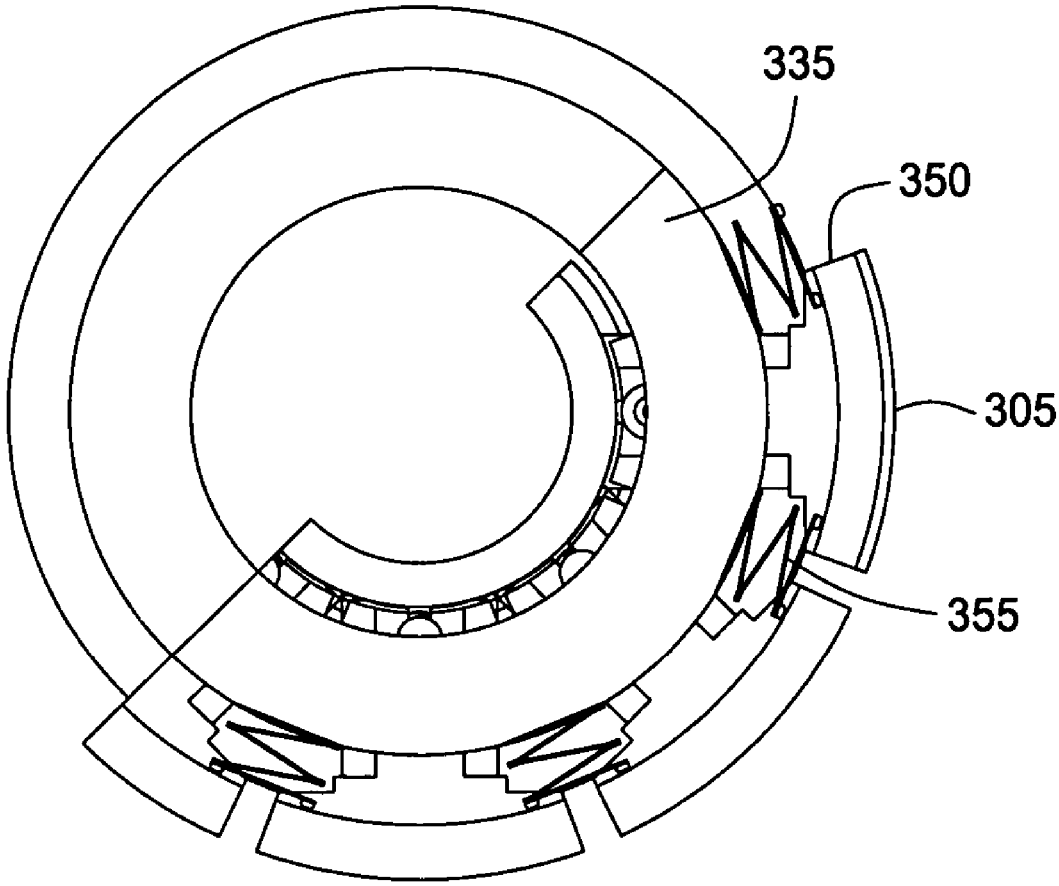
FIG. 9 is a cross-sectional view of another embodiment of a gripping element according to aspects of the present invention.

In another embodiment, the gripping element 305 may include a collar 350 on either side, instead of the upper or lower end. As shown in FIG. 9, a biasing member 355 is disposed between two adjacent gripping elements 305. Additionally, the biasing member 355 is between the side collars 350 and the body 335. In this respect, the biasing member 355 may be used to control the position of the gripping elements 305. In one embodiment, the biasing member 355 may comprise one or more retracting blade springs.

In another aspect, the torque head 40 may optionally employ a circulating tool 280 to supply fluid to fill up the casing 30 and circulate the fluid. The circulating tool 220 may be connected to a lower portion of the mandrel 203 and at least partially disposed in the body 235. The circulating tool 280 includes a first end and a second end. The first end is coupled to the mandrel 203 and fluidly communicates with the top drive 50. The second end is inserted into the casing 30. A cup seal 285 is disposed on the second end interior to the casing 30. The cup seal 285 sealingly engages the inner surface of the casing 30 during operation. Particularly, fluid in the casing 30 expands the cup seal 285 into contact with the casing 30. The circulating tool 280 may also include a nozzle 288 to inject fluid into the casing 30. The nozzle 288 may also act as a mud saver adapter for connecting a mud saver valve (not shown) to the circulating tool 280.

It addition to casing, aspects of the present invention are equally suited to handle tubulars such as drill pipe, tubing, and other types of tubulars known to a person of ordinary skill in the art. Moreover, the tubular handling operations contemplated herein may include connection and disconnection of tubulars as well as running in or pulling out tubulars from the well.

While the foregoing is directed to embodiments of the present invention, other and further embodiments of the invention may be devised without departing from the basic scope thereof, and the scope thereof is determined by the claims that follow.

I claim:

1. A method of handling a tubular using a top drive, comprising:

operatively connecting a gripping head to the top drive, the gripping head having:

a housing;

a plurality of gripping elements radially disposed in the housing for engaging the tubular; and a plurality of engagement members movably coupled to each of the plurality of gripping elements;

disposing the tubular within the plurality of gripping elements;

moving the housing relative to the plurality of gripping elements;

engaging the tubular; and activating the plurality of engagement members.

2. The method of claim 1, wherein applying an axial load activates the plurality of engagement members.

3. The method of claim 1, further comprising moving the plurality of gripping elements radially while moving the housing relative to the plurality of gripping elements.

4. The method of claim 1, further comprising biasing the plurality of gripping elements away from the casing.

5. The method of claim 1, wherein activating the plurality of engagement members comprises pivoting the plurality of engagement members.

6. A method of handling a tubular, comprising:

providing a tubular gripping member having a gripping element, wherein the gripping element carries a plurality of engagement members;

moving the gripping element radially toward the tubular, thereby engaging the tubular with the plurality of engagement members; and causing at least one of the plurality of engagement members to pivot relative to the gripping element, thereby gripping the tubular.

7. The method of claim 6, wherein the gripping element is disposed in a housing.

8. The method of claim 7, further comprising moving the housing to cause radial movement of the gripping element.

9. The method of claim 6, further comprising rotating the tubular gripping member.

10. The method of claim 6, wherein the at least one of the plurality of engagement members is pivoted from a first tubular engagement position to a second tubular engagement position.

11. The method of claim 10, wherein pivotal movement of the at least one of the plurality of engagement members is caused by a weight of the tubular.

12. A tubular gripping member for gripping a tubular for use with a top drive, comprising:

a body operatively coupled to the top drive; and a gripping element movably coupled to the body, wherein the gripping element carries a plurality of engagement members in movable relation to the gripping element, wherein each of the plurality of engagement members are distributed axially along the gripping element and are movable independently from each other.

13. The tubular gripping member of claim 12, wherein the gripping element is movable to a tubular gripping position and the plurality of engagement members are movable to a tubular engagement position therefrom.

14. The tubular gripping member of claim 13, wherein the body is movable relative to the top drive.

15. The tubular gripping member of claim 14, further comprising an actuator for moving the body.

16. The tubular gripping member of claim 15, wherein the actuator comprises a hydraulic cylinder.

17. The tubular gripping member of claim 14, wherein movement of the body causes the gripping element to move to the tubular gripping position.

18. The tubular gripping member of claim 17, wherein movement of the gripping element comprises radial movement.

19. The tubular gripping member of claim 17, wherein moving the plurality of engagement members to the tubular engagement position is caused by a weight of the tubular.

20. The tubular gripping member of claim 17, wherein the body moves axially.

21. The tubular gripping member of claim 20, wherein movement of the gripping element comprises radial movement.

22. The tubular gripping member of claim 21, wherein movement of the plurality of engagement members comprise pivotal movement relative to the gripping element.

23. The tubular gripping member of claim 12, wherein the gripping member is rotatable by the top drive.

24. The tubular gripping member of claim 12, further comprising a retracting mechanism to control movement of the plurality of engagement members.

25. The tubular gripping member of claim 24, wherein the retracting mechanism comprises an actuating rod, wherein moving the actuating rod between an upward position and a downward position respectively moves the plurality of engagement members between a retracted position and an engaged position.

26. The tubular gripping member of claim 12, wherein movement of the plurality of engagement members comprise pivotal movement relative to the gripping element.

27. The tubular gripping member of claim 12, wherein the tubular comprises a casing.

28. The tubular gripping member of claim 12, wherein the plurality of engagement members has a first engagement position and a second engagement position relative to the gripping member.

29. The tubular gripping member of claim 28, wherein the plurality of engagement members are rotatable from the first engagement position to the second engagement position to further engage the tubular.

30. The tubular gripping member of claim 28, further comprising a retracting member adapted to bias the plurality of engagement members in the first engagement position.

31. The tubular gripping member of claim 12, wherein the plurality of engagement members are rotatable relative to an axis perpendicular to an axis of the tubular.

32. The tubular gripping member of claim 12, further comprising a biasing member disposed between the body and the gripping element.

33. The tubular gripping member of claim 12, further comprising a piston and cylinder assembly for moving the body.

* * * * *